US007913483B2

(12) United States Patent
Qiu et al.

(10) Patent No.: US 7,913,483 B2
(45) Date of Patent: Mar. 29, 2011

(54) EMBEDDED TYPE SYSTEM POSITIONING SPINNING METHOD

(75) Inventors: Yafu Qiu, Jining (CN); Weilin Xu, Wuhan (CN); Dong Qiu, Jining (CN); Cailing Ding, Jining (CN); Weigang Cui, Wuhan (CN); Wenge Wang, Jining (CN); Xiaolin Shen, Wuhan (CN); Aiguo Yang, Jining (CN); Baocang Li, Jining (CN); Jianping Wang, Jining (CN); Guang Qin, Jining (CN)

(73) Assignee: Shandong Ruyi Science & Technology Group, Jining, Shandong Province (CN)

( * ) Notice: Subject to any disclaimer, the term of this patent is extended or adjusted under 35 U.S.C. 154(b) by 121 days.

(21) Appl. No.: 12/371,603

(22) Filed: Feb. 15, 2009

(65) Prior Publication Data

US 2010/0162677 A1 Jul. 1, 2010

(30) Foreign Application Priority Data

Dec. 31, 2008 (CN) ..... 2008 10 246351

(51) Int. Cl.
*D02G 3/36* (2006.01)

(52) U.S. Cl. ..... 57/5; 57/10; 57/12; 57/18

(58) Field of Classification Search ..... 57/3, 5, 57/10, 12, 13, 17, 18
See application file for complete search history.

(56) References Cited

U.S. PATENT DOCUMENTS 3,264,816 A * 8/1966 Markus ..... 57/12
4,484,436 A * 11/1984 Nakayama et al. ..... 57/328
4,903,472 A * 2/1990 Vanhelle ..... 57/12
5,115,630 A * 5/1992 Vanhelle ..... 57/58.59
5,531,063 A * 7/1996 Sawhney et al. ..... 57/12
6,318,060 B1 * 11/2001 Dinkelmann et al. ..... 57/3

* cited by examiner

*Primary Examiner* — Shaun R Hurley

(57) ABSTRACT

On each draft element of a ring spinning frame, two pieces of short-staple roving from the roving bobbin enter into the draft mechanism to be drafted though a guide funnel in parallel, two pieces of filament are fed from the back of the front roller, and combine with two pieces of roving at front jaw respectively. The drafted two pieces of roving and filament are output from the front jaw and enter into the twisting triangle area to be twisted, and then are wound onto a yarn bobbin to produce yarn. Based on the relative position of the two pieces of roving and two pieces of filament, different yarns can be produced. Furthermore, multi-component yarn, such as core structure, wrapped structure, strand-like structure, can be produced on a ring spinning frame. The structure of yarn can be precisely determined. Special fiber yarn can be produced on traditional spinning frame.

15 Claims, 4 Drawing Sheets

EMBEDDED TYPE SYSTEM POSITIONING SPINNING METHOD

BACKGROUND OF THE PRESENT INVENTION

1. Field of Invention

The present invention relates to a spinning process, and more particularly to a spinning method that can produce yarns of various structures using a ring spinning frame.

2. Description of Related Arts

With the development of the textile material and increasing demand for style and design of the costume fabric, the demand for spinning process is higher and higher, such as super high count yarn and multi-component composite yarn. More researches focus on the spinning process, and various spinning processes have been developed, such as Sirofil spinning, Siro spinning, compact spinning, and cable spinning. These new spinning processes greatly improve the yarn quality. For example, Sirofil spinning can produce the core structure yarn with a filament and a short-staple roving; Siro spinning can double and twist two rovings, which can improve the spinning quality and the fineness of the yarn; cable spinning divides a roving into many strands using a groovy roller and doubles and twists the strands, so as to reduce the hairiness of the yarn and improve the yarn quality; compact spinning controls the movement of the fiber of the twisting strands to reduce the formation of the hairiness by utilizing negative pressure wind suction or magnetic loading, so as to improve the density and quality of the yarn. However, the above-mentioned spinning processes still can not meet the demand for various types of yarns. For example, though Sirofil spinning can produce the core structure yarn with a filament and a short-staple roving, the wrapping effect is not very good, i.e. the yarn in center easily comes out; Siro spinning can double and twist two rovings, but there will be a lot of broken ends when producing the high count yarn, because the number of the fibers of each roving strand in the twisting triangle area is very small.

SUMMARY OF THE PRESENT INVENTION

An object of the present invention is to provide an embedded type system positioning spinning method, which can produce the multi-component multi-structure yarn on one ring spinning frame, so as to meet the demand for new textile materials and special structures.

Accordingly, in order to accomplish the above object, the present invention provides an embedded type system positioning spinning method. On each draft element of a ring spinning frame, two short-staple rovings a and a' from the roving bobbin enter the draft mechanism to be drafted through two guide funnels in parallel, respectively, wherein the draft mechanism comprises a back roller, a back leather roller, a middle roller, a middle leather roller, an apron, a front roller and a front leather roller; two filaments b and b' are fed from the back of the front roller via a guide wire or a guide wheel, wherein the two filaments b and b' are parallel with the two rovings a and a' respectively, and the filament b meets with the roving a and the filament b' meets with the roving a' at a front jaw. The drafted two rovings a and a' and two filaments b and b' enter a twisting triangle area to be twisted, and then are wound onto a yarn bobbin via a guide wire.

The parallel filaments b and b' are fed via a guide wire or a guide wheel. At the front jaw, the relative positions between the parallel filaments b and b' and the parallel rovings a and a' are illustrated as follows respectively. The filaments b and b' are at the inner side of the rovings a and a'; the filaments b and b' are at the outer side of the rovings a and a'; the filament b overlaps the roving a and the filament b' overlaps the roving a'; the roving a is between the filaments b and b', and the roving a' is at the outer side of the filament b'. The two short-staple rovings a and a' are made of the same material or different materials; the two filaments b and b' are made of the same material or different materials; the two filaments b and b' are silk or chemical fiber filament or spun yarn made of short fibers.

In the above process, by changing the relative position between the fed two short-staple rovings and two filaments, the multi-component yarn with core structure, wrapped structure, or strand-like structure can be produced on one ring spinning frame. The structure of the yarn can be precisely determined. The structure of the yarn is more compact, and the hairiness and strength of the yarn are better. In the present invention, the two filaments can strengthen the output two rovings in the twisting triangle area, so as to prevent the breaking ends. Special fiber yarns, such as hemp and apocynum, can be produced on a traditional spinning device, so that the range of textile material is enlarged. At the same time, the alteration on the original device is simple and the altered device is convenient to use.

DETAILED DESCRIPTION OF THE PREFERRED EMBODIMENT

Figure 1:
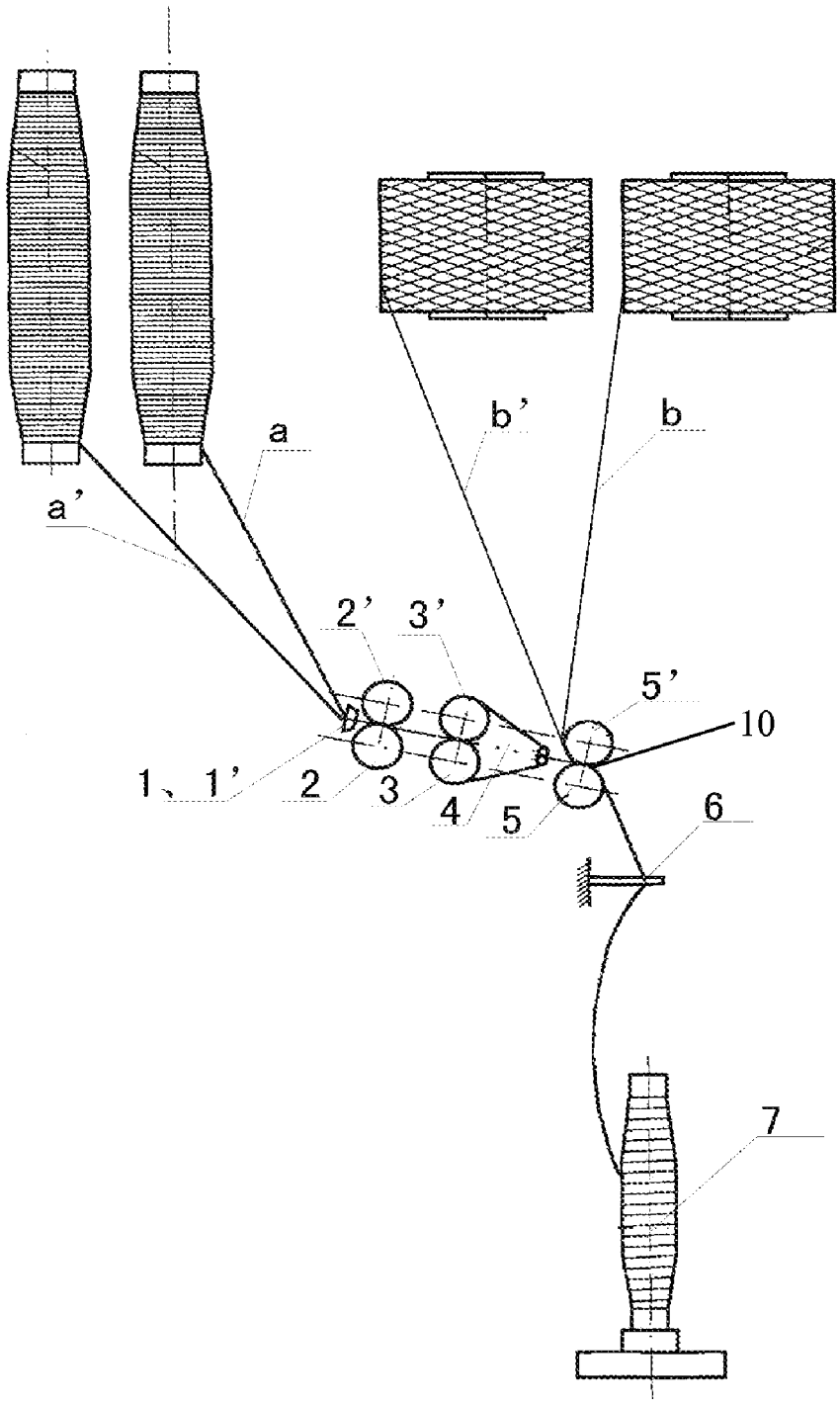
FIG. 1 is a schematic view of a spinning process according to a preferred embodiment of the present invention.
Figure 2:
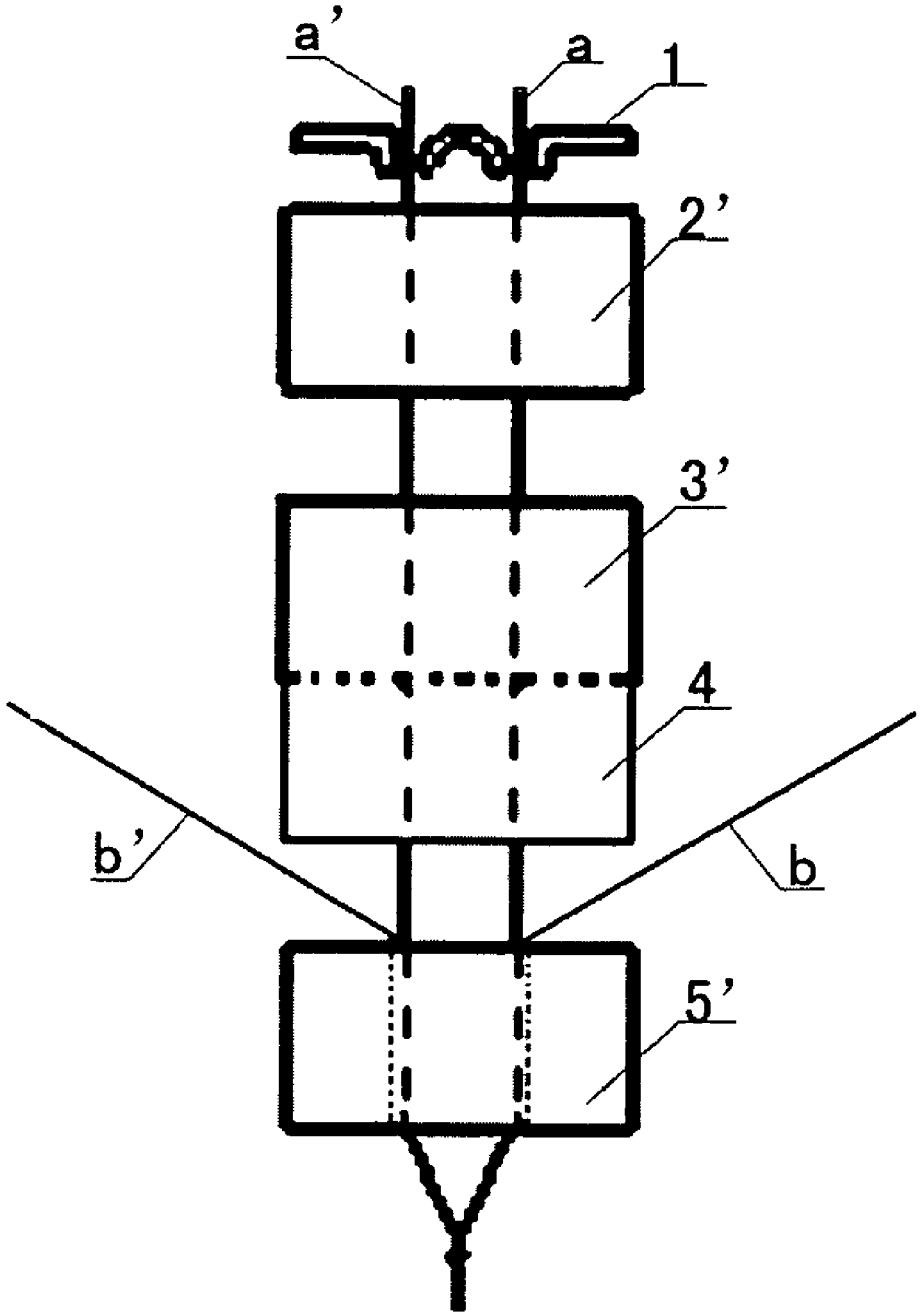
FIG. 2 is a schematic view of a twisting area of FIG. 1.
Figure 3:
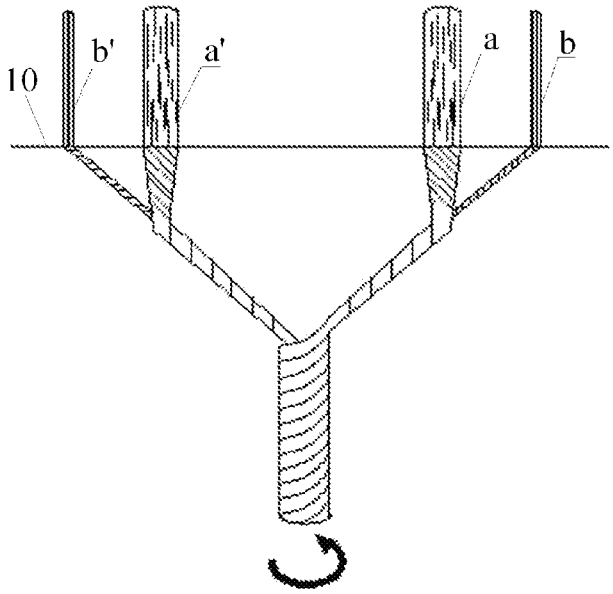
FIG. 3 is a schematic view, illustrating the filaments are fed at the outer side of the rovings.
Figure 4:
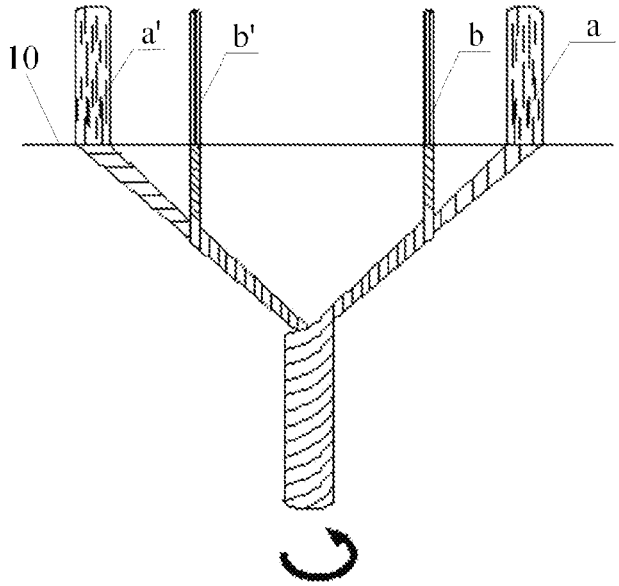
FIG. 4 is a schematic view, illustrating the filaments are fed at the inner side of the rovings.
Figure 5:
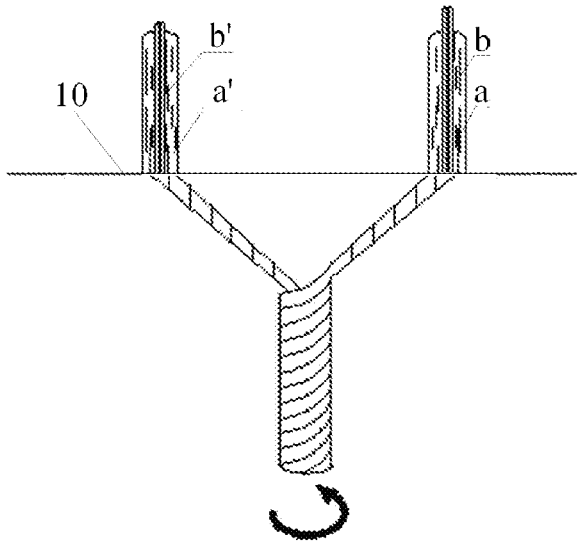
FIG. 5 is a schematic view, illustrating the filament overlaps the roving.
Figure 6:
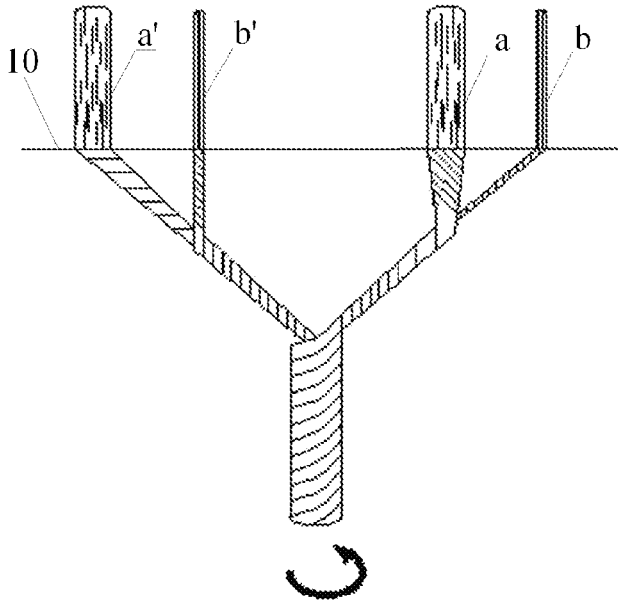
FIG. 6 is a schematic view, illustrating two filaments alternates with two rovings.

Referring to FIGS. 1 and 2 of the drawings, on each draft element of a ring spinning frame, two short-staple rovings a and a' from the roving bobbin enter the draft mechanism to be drafted through two guide funnels 1 and 1' in parallel, respectively, wherein the draft mechanism comprises a back roller 2, a back leather roller 2', a middle roller 3, a middle leather roller 3', an apron 4, a front roller 5 and a front leather roller 5'; two filaments b and b' are fed from the back of the front roller 5, and meet with the two rovings a and a' respectively at a front jaw 10 comprising the front roller 5 and the front leather roller 5'. After being output from the front jaw 10, the drafted two rovings a and a' and two filaments b and b' enter a twisting triangle area to be twisted, and then are wound onto a yarn bobbin 7 via a guide wire 6.

FIGS. 3 to 6 are schematic views of the operating principle of the present invention, when the two filaments b and b' and two short-staple rovings a and a' are fed from different relative positions. When the filaments b and b' and short-staple rovings a and a' are fed from different relative positions, integrating with different feeding tensions of the filaments b and b', different diameters of the filaments b and b' and different twist factors, different yarn structures can be obtained. Referring to the feeding position shown in FIG. 3, a wrapped yarn can be produced with the short-staple roving inside and filament outside. Referring to the feeding position shown in FIG. 4, a core spun yarn can be produced with the filament inside and short-staple roving outside. Referring to the feeding position shown in FIGS. 5 and 6, a kind of yarn similar to a strand structure can be produced. Of course, when the processing parameters are set improperly, a disordered structure with entangled filament and shot-staple roving may be produced. However, the overall quality level, such as hairiness and strength, still can be improved.

The present invention can be applied into spinning processes, such as wool spinning, cotton spinning, linen spinning, and silk spinning, that is to say that the short-staple roving can be cotton, wool, linen, silk and roving made of short chemical fiber. The two short-staple rovings can be made of the same material or different materials. The filament can be chemical fiber, silk or yarn made of short fibers.

The present invention can also be applied to produce high count yarn and super-high count yarn, and to produce the fiber yarn that is difficult to be produced in conventional spinning methods, such as the short fiber, low ultra fine wool yarn, kapok fiber, alginate fiber, apocynum fiber, basalt fiber, hemp fiber, and rabbit hair, which has short fiber, poor cohesive force and low strength. Therefore, the present invention can be applied to various materials.

The present invention can also achieve the effect of Siro spinning and Sirofil spinning by changing the number of the fed short-staple roving and filament. The present invention can replace the Siro spinning and Sirofil spinning. When the two rovings are combined to be one or one roving is fed, the yarn produced has the yarn structure of Sirofil spinning. When only two rovings are fed without filament, the yarn produced has the yarn structure of Siro spinning. There can be many other variations in the present invention, for example, two rovings and one filament are fed, wherein the filament is between the two rovings; one roving and two filaments are fed, wherein the roving is between the two filaments. Therefore, many kinds of compound yarn can be produced in the present invention, which can be widely used.

The features and applications of the present invention are further illustrated in the following examples.

Example 1

Producing the Silk Style Yarn by the Cotton Ring Spinning Frame

Two cotton rovings a and a' from the roving bobbin enter the draft mechanism to be drafted through two guide funnels 1 and 1' in parallel, respectively; two silks b and b' are fed from the back of the front roller 5 via a guide wire or a guide wheel. The silks b and b' must be parallel with the cotton rovings a and a' respectively. The silks b and b' are at the outer side of the cotton rovings a and a'. The drafted two cotton rovings a and a' and two silks b and b' are output from the front jaw 10 and enter the twisting triangle area to be twisted, and then are wound onto a yarn bobbin 7 via a guide wire 6. The yarn produced in this method has silk surface and cotton roving core, so that the fabric made of this kind of yarn has silk style, and cost is extremely lowered.

Example 2

Producing the Wool Core Spun Yarn

Two wool rovings a and a' from the roving bobbin enter into the draft mechanism to be drafted through two guide funnels 1 and 1' in parallel, respectively; two polyester filaments b and b' are fed from the back of the front roller 5 via a guide wire or a guide wheel. The polyester filaments b and b' must be parallel with the wool rovings a and a' respectively. The polyester filaments b and b' are at the inner side of the wool rovings a and a'. The drafted two wool rovings a and a' and two polyester filaments b and b' are output from the front jaw 10 and enter into the twisting triangle area to be twisted, and then are wound onto a yarn bobbin 7 via a guide wire 6. The yarn produced in this method has wool surface and polyester filament core, so that the yarn has wool style, and cost is extremely lowered.

Example 3

Producing the Ramie High Count Yarn

Two ramie rovings a and a' from the roving bobbin enter the draft mechanism to be drafted through two guide funnels 1 and 1' in parallel, respectively; two fine denier polyester filaments of 50-200 denier b and b' are fed from the back of the front roller 5 via a guide wire or a guide wheel. The polyester filaments b and b' must be parallel with the ramie rovings a and a' respectively, wherein the polyester filament b and the roving a overlap and the polyester filament b' and the roving a' overlap. The drafted two ramie rovings a and a' and two polyester filaments of b and b' are output from the front jaw 10 and enter the twisting triangle area to be twisted, and then are wound onto a yarn bobbin 7 via a guide wire 6.

The ramie is difficult to be used to produce high count yarn, because of crude fiber, high stiffness and poor cohesive force. Though high count yarn with over 80 deniers can be produced by adopting Sirofil spinning, the produced yarn is the ordinary core structure. The ramie fiber easily peels off, which will affect subsequent processing and using effect. By adopting the above process, the produced yarn corresponds that two yarns of Sirofil spinning are twisted, and the polyester filament and ramie roving are entangled to be combined more closely, so as to prevent the ramie fiber from falling off, and obviously improve the hairiness of the yarn.

Example 4

Producing the Wool High Count Yarn

Two rovings made of ultra fine wool a and a' from the roving bobbin enter the draft mechanism to be drafted through two guide funnels 1 and 1' in parallel, respectively; two fine denier water soluble vinylon filaments of 20-50 denier b and b' are fed from the back of the front roller 5 via a guide wire or a guide wheel. The polyester filaments b and b' must be parallel with the ramie rovings a and a' respectively, wherein the water soluble vinylon filaments b and b' are at the outer side of the rovings a and a'. The drafted two rovings a and a' and two water soluble vinylon filaments b and b' are output from the front jaw 10 and enter the twisting triangle area to be twisted, and then are wound onto a yarn bobbin 7 via a guide wire 6. The yarn with water soluble vinylon filament wrapping wool is produced. Dissolve the water soluble vinylon filament in hot water to produce the high count pure wool yarn. In order to improve the fineness of the yarn, two rovings a and a' can be combined, that is to feed only one roving.

The super high count yarn is usually 120 Ne cotton yarn or 220 Nm wool yarn. Because the number of the fibers in the cross section is very small due to high count, the yarn is difficult to be directly spun, so that water soluble filament is used during the spinning, and then the water soluble filament is dissolve. At present the super high count yarn is mainly produced by adopting filament Sirofil spinning. Because the number of the fibers in the cross section is very small, by adopting Sirofil spinning, the core is not well wrapped, there are a lot of broken ends during the spinning, and a lot of hairiness appear on the fiber after the water soluble filament is dissolved, which will affect the quality. However, the fiber made of the super high count yarn produced in the present invention has good quality, because the fiber of the accompanying filament is on the surface of the yarn, and the dissolving of the filament will not affect the structure of the yarn. At the same time, the filament can support the strands output from the front jaw 10, which can also prevent the yarn from breaking during the spinning, so as to improve the spinning efficiency.

Example 5

Producing the Special Fiber Yarn

At present, with the development of the fiber processing technology, a lot of natural fibers with excellent performances are developed, such as hemp fiber and apocynum fiber. These fibers are difficult to be spun on the spinning frame, due to short fiber length and low fiber strength. By adopting the process of the present invention, these fibers can be spun. Taking hemp as an example, the process is illustrated in detail as below.

Two rovings made of hemp a and a' from the roving bobbin enter the draft mechanism to be drafted through two guide funnels 1 and 1' in parallel, respectively; two fine denier polyesters or other chemical filaments of 20-120 denier b and b' are fed from the back of the front roller 5 via a guide wire or a guide wheel. The filaments b and b' must be parallel with the hemp rovings a and a' respectively, wherein the roving a is between the filaments b and b', and the roving a' is at the outer side of the filament b'. The drafted two rovings a and a' and two filaments b and b' are output from the front jaw 10 and enter the twisting triangle area to be twisted, and then are wound onto a yarn bobbin 7 via a guide wire 6. The chemical fibers of the filament improve the strength of the hemp fiber, so as to ensure that the hemp fiber can be twisted after being output from the front jaw 10, and prevent the hemp fiber from breaking in the twisting triangle area. The filament in the yarn can ensure the integrity of the yarn, and the filament wraps the short fiber of hemp, the yarn has the feature of the hemp fiber.

Example 6

Producing the Untwisted Yarn

The fibers in the center of the untwisted yarn are straight, parallel and untwisted, and the fiber on the surface is wound on the surface of the yarn. The untwisted yarn is puffy, and is a good material to make towel and underwear. At present, the untwisted yarn is processed using Sirofil spinning, and the quality of the yarn is not very good. The process of the present invention is illustrated in detail as below.

Two rovings made of long-staple cotton a and a' from the roving bobbin enter the draft mechanism to be drafted through two guide funnels 1 and 1' in parallel, respectively; two high count (over 80 Ne) S twist short-staple yarns b and b' are fed from the back of the front roller 5 via a guide wire or a guide wheel. The S twist short-staple yarns b and b' must be parallel with the cotton rovings a and a' respectively, wherein the S twist short-staple yarns b and b' are at the inner side of the cotton rovings a and a'. The drafted two rovings a and a' and two S twist yarns b and b' are output from the front jaw 10 and enter the twisting triangle area to be twisted, and then are wound onto a yarn bobbin 7 via a guide wire 6 to produce the Z twist untwisted yarn with parallel fiber in center and winding fiber on the surface. In order to improve the count of the yarn, one S twist short-staple yarn can be fed, and this yarn is between two rovings a and a'. In this process, the Z twist untwisted yarn with parallel fiber in center and winding fiber on the surface can also be produced.

Example 7

Producing the Polyester Viscose Blended Elastic Yarn

Two rovings a and a' from the roving bobbin enter the draft mechanism to be drafted through two guide funnels 1 and 1' in parallel, respectively, wherein the roving a is made of viscose staple fiber, and a' is made of polyester staple fiber; two polyurethane filaments b and b' are fed from the back of the front roller 5 via a guide wire or a guide wheel. The polyurethane filaments b and b' must be parallel with the rovings a and a' respectively, wherein the polyurethane filaments b and b' are at the inner side of the viscose roving a and the polyester roving a'. The drafted two rovings a and a' and two polyurethane filaments b and b' are output from the front jaw 10 and enter the twisting triangle area to be twisted, and then are wound onto a yarn bobbin 7 via a guide wire 6 to produce the polyester viscose blended elastic yarn.

Example 8

Producing the Silk Type Elastic Yarn Spun on a Cotton Ring Spinning Frame

Two cotton rovings a and a' from the roving bobbin enter the draft mechanism to be drafted through two guide funnels 1 and 1' in parallel, respectively; silk b and polyurethane filament b' are fed from the back of the front roller 5 via a guide wire or a guide wheel. The silk b and polyurethane filament b' must be parallel with the cotton rovings a and a' respectively, wherein the silk b is at the outer side of the cotton rovings a and a', and the polyurethane filament b' are at the inner side of the cotton rovings a and a'. The drafted two cotton rovings a and a' and silk b and polyurethane filament b' are output from the front jaw 10 and enter the twisting triangle area to be twisted, and then are wound onto a yarn bobbin 7 via a guide wire 6. The yarn produced in this process has silk surface, cotton in middle and polyurethane filament core. The fabric made of this yarn has silk style, and good elasticity. The use of cotton lowers the cost of the yarn.

What is claimed is:

1. An embedded type system positioning spinning method, comprising the steps of:

on each draft element of a ring spinning frame, drafting a first short-staple roving and a second short-staple roving from two roving bobbins by feeding the first short-staple roving and the second short-staple roving to a draft mechanism through two guide funnels in parallel, respectively, wherein the draft mechanism comprises a first back roller, a second back roller, a first middle roller, a second middle roller, an apron, a first front roller and a second front roller, wherein the first front roller and the second front roller forms a front jaw therebetween;

feeding a first filament and a second filament in parallel with the first filament to the first short-staple roving and the second short-staple roving respectively from a back end of the first front roller via a guide wire or a guide wheel, wherein after the first short-staple roving, the second short-staple roving, the first filament and the second filament enter the first front roller, the first filament and the second filament are parallel with the first short-staple roving and the second short-staple roving, respectively;

after outputting the drafted first and second roving and the first and second filament from the front jaw, assembling the first short-staple roving and the first filament and twisting the assembled first short-staple roving and first filament to be a first intermediate yarn in a twisting triangle area, simultaneously, assembling the second short-staple roving and the second filament and twisting the assembled second short-staple roving and second filament to be a second intermediate yarn in the twisting triangle area, assembling the first intermediate yarn and the second intermediate yarn, and twisting the assembled first intermediate yarn and second intermediate yarn in the twisting triangle area to be a twisted yarn; and winding the twisted yarn onto a yarn bobbin via a guide wire.

2. The embedded type system positioning spinning method, as recited in claim 1, wherein in the step of feeding the first and second filament, each of the first roving and the second roving is provided between the first filament and the second filament.

3. The embedded type system positioning spinning method, as recited in claim 2, wherein each of the first roving and the second roving is cotton roving, each of the first filament and the second filament is silk.

4. The embedded type system positioning spinning method, as recited in claim 2, wherein each of the first roving and the second roving is ultra fine wool roving, each of the first filament and the second filament is fine denier water soluble vinylon filament.

5. The embedded type system positioning spinning method, as recited in claim 4, further comprising the step of dissolving the water soluble filament after winding.

6. The embedded type system positioning spinning method, as recited in claim 2, wherein each of the first roving and the second roving is cotton roving, the first filament is silk, and the second filament is polyurethane.

7. The embedded type system positioning spinning method, as recited in claim 1, wherein in the step of feeding the first and second filament, each of the first filament and the second filament is provided between the first roving and the second roving.

8. The embedded type system positioning spinning method, as recited in claim 7, wherein each of the first roving and the second roving is wool roving, each of the first filament and the second filament is polyester filament.

9. The embedded type system positioning spinning method, as recited in claim 7, wherein each of the first roving and the second roving is long-staple cotton roving, each of the first filament and the second filament is S twist short-staple yarn.

10. The embedded type system positioning spinning method, as recited in claim 7, wherein the first roving is made of viscose staple fiber, and the second roving is made of polyester staple fiber, each of the first filament and the second filament is polyurethane filament.

11. The embedded type system positioning spinning method, as recited in claim 1, wherein in the step of feeding the first and second filament, the first roving overlaps the first filament, and the second roving overlaps the second filament.

12. The embedded type system positioning spinning method, as recited in claim 11, wherein each of the first roving and the second roving is ramie roving, each of the first filament and the second filament is fine denier polyester filament.

13. The embedded type system positioning spinning method, as recited in claim 1, wherein in the step of feeding the first and second filament, the first filament is provided between the first roving and second roving, the second roving is provided between the first filament and the second filament.

14. The embedded type system positioning spinning method, as recited in claim 13, wherein each of the first roving and the second roving is hemp roving, each of the first filament and the second filament is chemical filament.

15. The embedded type system positioning spinning method, as recited in claim 13, wherein each of the first roving and the second roving is hemp roving, each of the first filament and the second filament is chemical filament.

* * * * *